US007568998B2

(12) United States Patent
Gallus et al.

(10) Patent No.: US 7,568,998 B2
(45) Date of Patent: Aug. 4, 2009

(54) TRAMPOLINE BALANCE BEAM

(76) Inventors: Laurie A. Gallus, 11 Field Ave., Proctor, VT (US) 05765; Gary D. Gallus, 11 Field Ave., Proctor, VT (US) 05765

( * ) Notice: Subject to any disclaimer, the term of this patent is extended or adjusted under 35 U.S.C. 154(b) by 0 days.

(21) Appl. No.: 11/906,981

(22) Filed: Oct. 5, 2007

(65) Prior Publication Data

US 2009/0093343 A1 Apr. 9, 2009

(51) Int. Cl.
*A63B 21/00* (2006.01)

(52) U.S. Cl. ..... 482/35; 482/23

(58) Field of Classification Search ..... 482/31–35, 482/23, 121, 13, 36, 37, 38, 41, 112
See application file for complete search history.

(56) References Cited

U.S. PATENT DOCUMENTS 4,645,197 A * 2/1987 McFee ..... 482/31
5,037,086 A * 8/1991 Strand ..... 482/34
6,517,466 B2 * 2/2003 Eyman et al. ..... 482/34

* cited by examiner

*Primary Examiner*—Jerome Donnelly
(74) *Attorney, Agent, or Firm*—John J. Welch, Jr., Esq.

(57) ABSTRACT

A balance beam for training gymnasts has been invented. The balance beam has the capability of absorbing the downward momentum of a gymnast landing on the beam and then providing a near equal upward thrust to the gymnast allowing greater heights and longer air time in an immediately following jump thus facilitating the quicker learning of gymnastic skills. To achieve this, the beam is supported within a frame of similar dimension as the beam. The components which support the beam within the frame are located at each end of the beam and consist of a special arrangement of springs and elastic straps which represent the embodiment of the invention.

6 Claims, 4 Drawing Sheets

TRAMPOLINE BALANCE BEAM

CROSS REFERENCE TO RELATED APPLICATIONS

Not Applicable

FEDERALLY SPONSORED RESEARCH AND DEVELOPMENT

Not Applicable

SEQUENCE LISTING, TABLES, COMPUTER PROGRAM LISTINGS

Not Applicable

BACKGROUND OF THE INVENTION

A balance beam is an article of gymnastic equipment that provides an elevated surface upon which the gymnast performs a variety of exercises. The balance beam used in gymnastic competition has a surface which is four inches wide by sixteen feet long. The beam itself must be rigid and capable of supporting the gymnast's dynamic weight without significant flexing. While a variety of balance beams are available in the marketplace, the focus of this invention is in the class of beams used for the training of gymnasts as they develop the skills needed in competition. Training beams may incorporate some method of shock absorption as the gymnast returns to the beam after executing an exercise involving, for instance, jumping. This shock absorption reduces the potential for injury. Shock absorbing beams, currently available, only incidentally provide some upward impetus to the rebounding gymnast following landing on the beam to assist in accomplishing the next upward maneuver. It is the objective of the invention described herein to provide a significant upward impetus to the landing gymnast to allow the execution of higher rebounding jumps or other vertical maneuvers thereby providing increased time in the air and allowing the learner more time to execute the maneuver before returning to the beam. This beam improvement will result in faster acquisition of gymnastic skills than heretofore possible.

SUMMARY OF THE INVENTION

The invention incorporates the elements of the basic, non shock absorbing, non upward impetus providing, rigid, properly dimensioned balance beam in a manner that provides significant upward rebound to the gymnast. This rebound is maximized at each end of the beam providing valuable upward lift for the learning of many gymnastic exercises, such as dismounts, which require the gymnast to acquire adequate height for rotations and safe landings. The invention also provides for shock absorption along its entire length, in which the rebounding movement may be completely halted if the gymnast so desires.

The invention makes use of a rectangular frame whose dimensions are similar to the dimensions of the competition balance beam. The beam is supported within the frame by an arrangement of elastic straps and springs. The supporting devices are grouped at each of the two ends of the beam/frame combination. The end supporting arrangements are identical. There is no need for additional beam support between the ends.

The beam is positioned longitudinally within the frame by means of two sturdy helical tension springs between each beam end and the corresponding frame end. This arrangement prevents longitudinal movement of the beam within the frame due to gymnastic activity. The beam is supported vertically and laterally within the frame by a grouping of elastic straps, half of the straps are positioned at one end and half at the other. The middle of each strap may or may not be fixed to the bottom of the beam as it resides in the frame while the ends of each strap are stretched and fixed to each side of the frame thereby supporting the beam within the frame.

The implementation of this invention, as described later in this application, is of wood however other implementations, metal or plastic for instance, would be effective as well. Further, the implementation described herein conforms to the official balance beam dimensions. Other shorter or wider dimensions could be used employing this invention, if desired, while still gaining the invention's benefits. As described the balance beam assembly has only a small elevation above the supporting floor since, as a training device, the proximity to the floor reduces the risk of injury in case of an accident. The beam assembly, however, with suitable support, can be elevated higher above the floor even to competition height.

BRIEF DESCRIPTION OF THE DRAWINGS

The drawings that are provided to assist in understanding the invention are.

DETAILED DESCRIPTION OF THE INVENTION

Figure 1:
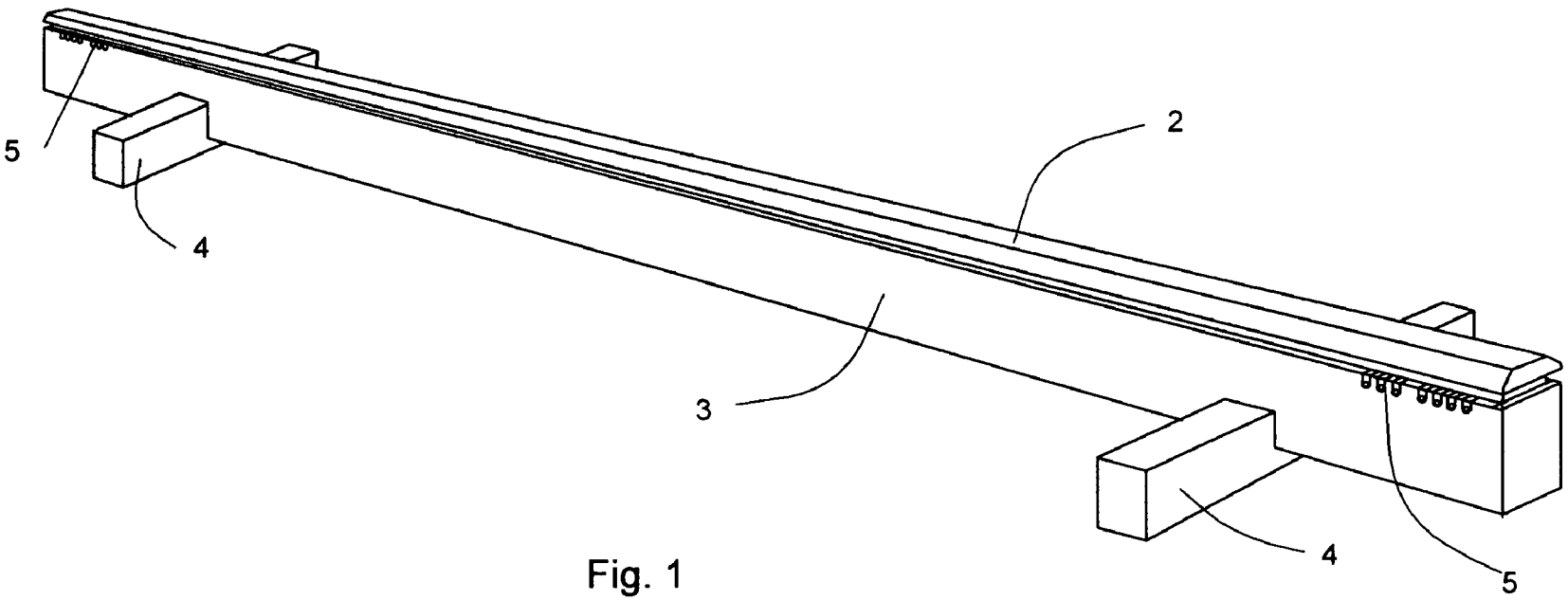
FIG. 1 provides a perspective view of the improved balance beam.

Referring to FIG. 1, it can be seen that the overall implementation of the invention incorporates a balance beam 2 which is partially enclosed and supported within a frame 3 of approximately the same dimensions. The frame is supported on the floor by a pair of cross members 4 rigidly affixed to the frame and stabilizing it with respect to the floor. The frame supports are conventional and do not meaningfully enter into the implementation of the invention and, hence, will not be discussed further. It may be observed from FIG. 1 that the beam 2 is supported at each end within the frame 3 by an arrangement of devices 5. These devices are the principal embodiment of the invention. The arrangement of these devices 5 are identical at each longitudinal end of the frame/beam assembly with the exception that the actual arrangement at each end is a mirror image of the other. The similarity of the device arrangement 5 at each end will allow the invention to be fully and completely described by describing the device arrangement 5 at one end only.

Figure 3:
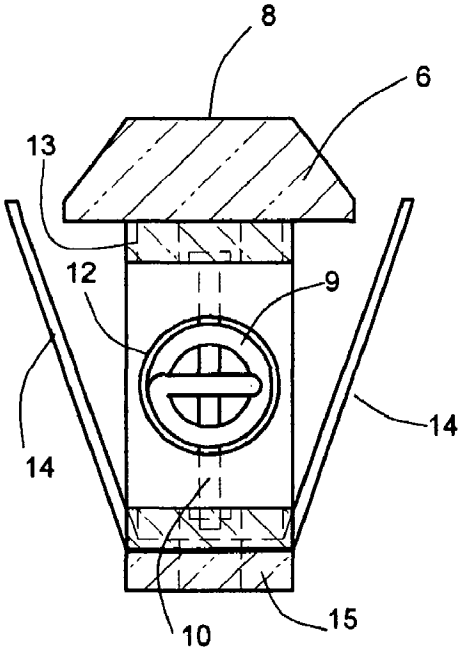
FIG. 3 is a cross-section of the portion of the beam shown in FIG. 2.
Figure 2:
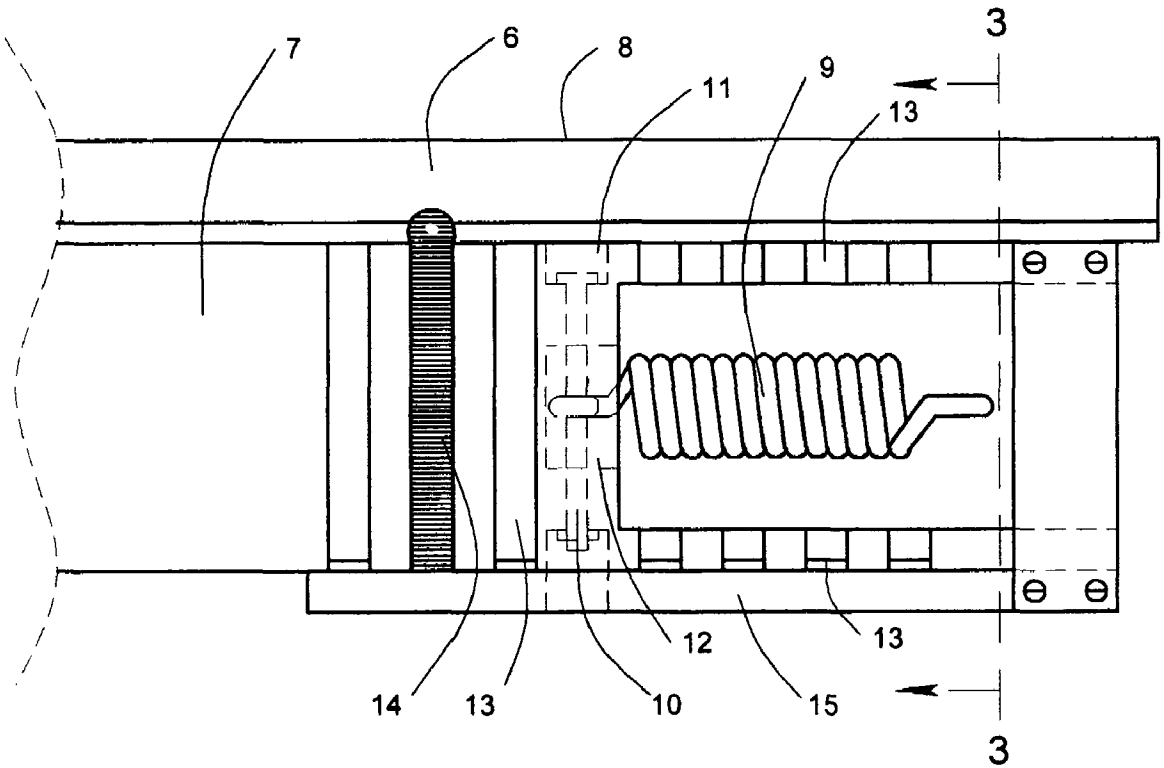
FIG. 2 is a longitudinal view of the end of the beam showing the placement of the supporting components.

Referring now to FIGS. 2 and 3 which partially shows the arrangement of devices 5 that constitute the invention. Note that the balance beam 2 is actually composed of an upper beam member 6 and a lower, supporting beam member 7. These two members are rigidly attached to each other by screws and glue or other means and are separate members only to make fabrication of each easier. The longitudinal dimension of the two beam members 6 and 7 is sixteen feet while the lateral dimension is not critical except that the performing surface 8 lateral dimension is set at four inches. The vertical dimension of the assembled beam members 6 and 7 is also not critical, the dimension being selected to achieve sufficient rigidity, considering the materials used, so that the beam will not flex unacceptably when in use by gymnasts.

The end of the support beam member 7 has a section cut from it to provide space for a strong steel tension spring 9 which is attached to the member 7 by means of a bolt 10 that is inserted into an appropriately sized hole 11 in the member 7. The bolt 10 is inserted through one loop end of the spring 9, the spring 9 having been inserted into an appropriately sized hole 12 drilled longitudinally into the cut out end of the member 7. The other loop end of the spring 9 is attached to the end of the frame 3 as shown in drawings, FIGS. 4 and 5 to be discussed subsequently. The springs 9 at each end of the beam 2 when stretched and attached to the frame 3 ends will position the beam 2 within the frame 3 so that longitudinal movement of the beam 2 is imperceptible and the beam 2 will not impinge upon the frame 3 but be free to move vertically during gymnastic activity.

The end of beam 2, which has been cut to provide space for the spring 9, is bridged by steel plates 17, one on each side of the extreme end of the beam 2. These plates 17 strengthen the end of the beam 2 and compensate for the missing beam material removed by the cut out section.

Note that seven channels 13 have been cut vertically into each of the vertical surfaces of the beam member 7. These channels 13 continue across the bottom surface of the beam member 7 thereby forming seven "U" shaped channels which will be used to hold seven elastic straps 14. One strap 14 has been shown as installed in FIGS. 3 and 4, the other six are not shown to improve the clarity of the drawings. The straps 14 may be secured in the bottom portion of channels 13 by screws or other devices passing through the straps 14 into the lower beam member 7 or the straps may be unattached to member 7. Further, the straps 14 are constrained by a suitably dimensioned board 15 which is fastened onto the bottom of the end of the lower beam member 7 by screws. The purpose of the stretched straps 14 are to attach the beam 2 to the frame 3 in a manner such that the beam 2 is allowed to move vertically with respect to the frame 3 while being constrained so that the vertical movement (which further stretches the straps 14) is limited to the desired value, approximately three inches, and allowing no perceptible side-to-side movement and providing only minimal frictional resistance to the vertical movement. While seven straps 14 have been shown in the figures, the actual number to be employed is determined by the elasticity and strength of the material from which the straps are manufactured balanced against the desired rebound impetus given the gymnast. The number of straps 14 actually employed in implementing the invention may be greater or fewer than the number used in this description.

Figure 4:
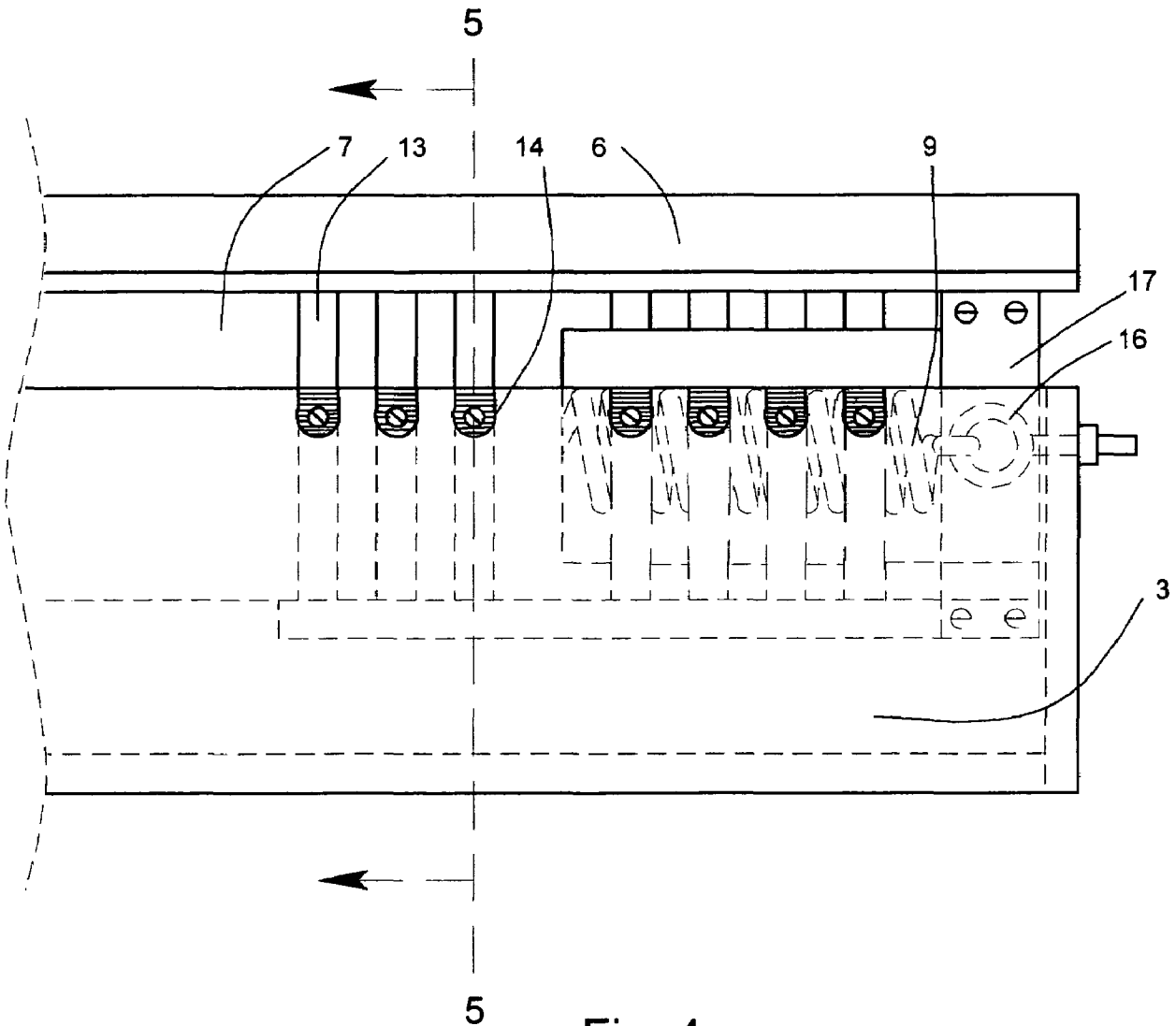
FIG. 4 is a longitudinal view of the end of the assembled balance beam within its supporting frame showing the placement of the supporting components.
Figure 5:
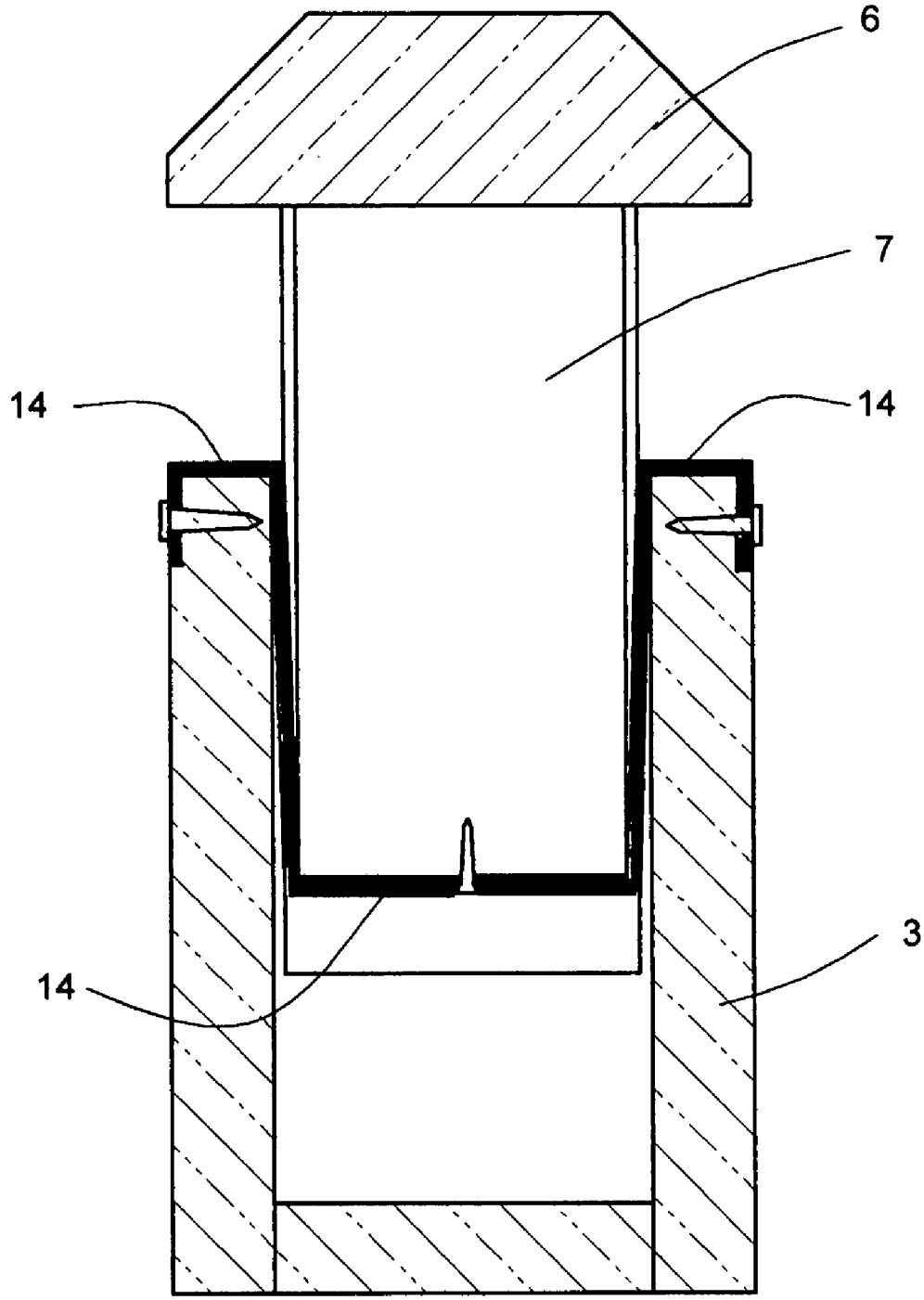
FIG. 5 is a cross section of the end of the assembled beam/frame combination shown in FIG. 4.

Referring now to FIGS. 4 and 5 which shows the beam 2 installed in the frame 3, note that an eye bolt 16 has secured the tension spring 9 to the end of frame 3 and has been used to stretch the spring tight providing the longitudinal constraint to movement of the beam 2 within the frame 3. Note also that the ends of straps 14 have been stretched and fastened into channels cut into each of the sides of frame 3 by means of screws allowing the beam 2 to be securely fastened at each end of the frame 3. As the gymnast exercises on the beam 2 the fourteen (seven on each end) elastic straps 14 further stretch as downward force is applied to the beam. The downward force is converted in to an upward force as the straps 14 then contract toward their original length. This upward force is delivered to the gymnast assisting her to jump higher (assuming a jump to be the next feat to be performed).

The above description makes reference to a particular construction. It should be obvious, however, that various aspects of the invention's implementation could be changed while still accruing the benefits of the described invention.

Generally a suede like material is used to cover the top surface of the beam to provide a non-slip surface for the gymnast. This covering has no bearing on the invention and has been omitted from the description above. It is expected that such a continuous flexible covering would extend over the top and side longitudinal surfaces of the assembled beam/frame combination.

We claim:

1. A balance beam assembly, comprising:

a. an elongated beam member;

b. a rectangular shaped frame;

c. said rectangular shaped frame having a bottomside connected to a first lateral side of said frame, a first end side of said frame, a second lateral side of said frame, and a second end side of said frame;

d. said first end side being connected to said first lateral side at a first end of said first lateral side and being connected to said second lateral side at a first end of said second lateral side;

e. said second end side being connected to said first lateral side at a second end of said first lateral side and being connected to said second lateral side at a second end of said second lateral side;

f. said rectangular shaped frame serving to house said elongated beam member;

g. a first plurality of elastic straps each affixed at first ends thereof to said first lateral side and at second ends thereof to said second lateral side nearer to said first end side than to said second end side;

h. a second plurality of elastic straps each affixed at first ends thereof to said first lateral side and at second ends thereof to said second lateral side nearer to said second end side than to said first end side;

i. said elongated beam member being partially housed within said rectangular shaped frame while positioned atop said so affixed first plurality of elastic straps and atop said so affixed said second plurality of elastic straps;

j. a first helical tension spring affixed at a first end thereof to inner walling of said first end side and affixed at a second end thereof to a first end side of said elongated beam member, and;

k. a second helical tension spring affixed at a first end thereof to inner walling of said second end side and affixed at a second end thereof to a second end side of said elongated beam member.

2. The balance beam assembly of claim 1 whereby, a first plurality of channels and a second plurality of channels are cut into lateral sides and a bottom side of said elongated beam member for receipt of said first plurality of elastic straps and said second plurality of elastic straps respectively; with each one of said first plurality of channels and each one of said second plurality of channels having a depth and a breadth suitable for receipt of one of said elastic straps.

3. The balance beam assembly of claim 1, whereby, said first helical tension spring and said second helical tension spring are each adjustable.

4. The balance beam assembly, comprising:

a. an elongated beam member;

b. a rectangular shaped frame;

c. said rectangular shaped frame having a bottomside connected to a first lateral side of said frame, a first end side of said frame, a second lateral side of said frame, and a second end side of said frame;

d. said first end side being connected to said first lateral side at a first end of said first lateral side and being connected to said second lateral side at a first end of said second lateral side;

e. said second end side being connected to said first lateral side at a second end of said first lateral side and being connected to said second lateral side at a second end of said second lateral side;

f. said rectangular shaped frame serving to house said elongated beam member;

g. a first plurality of elastic straps each affixed at first end thereof to said first lateral side and at second ends thereof to said second lateral side nearer to said first end side than to said second end side;

h. a second plurality of elastic swaps each affixed at first ends thereof to said first lateral side and at second ends thereof to said second lateral side nearer to said second end side than to said first end side;

i. said elongated beam member being partially housed within said rectangular shaped frame while positioned atop said so affixed first plurality of elastic straps and atop said so affixed said second plurality of elastic swaps;

j. a first helical tension spring affixed at a first end thereof to inner walling of said first end side and affixed at a second end thereof to a first end side of said elongated beam member, and;

k. a second helical tension spring affixed at a first end thereof to inner walling of said second end side and affixed at a second end thereof to a second end side of said elongated beam member.

l. a first cross member with length greater than a span as between outer walling of said first lateral side of said rectangularly shaped frame and outer walling of said second lateral side of said rectangularly shaped frame and being affixed to outer walling of said bottom side of said rectangularly shaped frame near said first end side thereof, and;

m. a second cross member with length greater than said span and being affixed to said outer walling of said bottom side of said rectangularly shaped frame near said second side thereof.

5. The balance beam assembly of claim 4 whereby, a first plurality of channels and a second plurality of channels are cut into lateral sides and a bottom side of said elongated beam member for receipt of said first plurality of elastic straps and said second plurality of elastic straps respectively; with each one of said first plurality of channels and each one of said second plurality of channels having a depth and a breadth suitable for receipt of one of said elastic straps.

6. The balance beam assembly of claim 1, whereby, said first helical tension spring and said second helical tension spring are each adjustable.

* * * * *